US011351781B2

(12) United States Patent
Kato

(10) Patent No.: US 11,351,781 B2
(45) **Date of Patent: *Jun. 7, 2022**

(54) LIQUID DISCHARGE HEAD

(71) Applicant: Brother Kogyo Kabushiki Kaisha, Nagoya (JP)

(72) Inventor: Yasuo Kato, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/139,028

(22) Filed: Dec. 31, 2020

(65) Prior Publication Data

US 2021/0122159 A1 Apr. 29, 2021

Related U.S. Application Data

(63) Continuation of application No. 16/938,456, filed on Jul. 24, 2020, now Pat. No. 10,913,271, which is a continuation of application No. 16/225,533, filed on Dec. 19, 2018, now Pat. No. 10,766,257.

(30) Foreign Application Priority Data

Mar. 16, 2018 (JP) ..... JP2018-050002

(51) Int. Cl.
*B41J 2/14* (2006.01)
*B41J 2/045* (2006.01)

(52) U.S. Cl.
CPC ..... *B41J 2/14201* (2013.01); *B41J 2/045* (2013.01); *B41J 2002/14362* (2013.01); *B41J 2002/14467* (2013.01); *B41J 2202/12* (2013.01)

(58) Field of Classification Search
CPC ..... B41J 2/14201; B41J 2/045; B41J 2/155; B41J 2/14233; B41J 2202/12; B41J 2202/11; B41J 2002/14467; B41J 2002/14241; B41J 2/14209; B41J 2002/14217; B41J 2002/1425
See application file for complete search history.

(56) References Cited

U.S. PATENT DOCUMENTS

| | | | |
|---|---|---|---|
| 8,632,165 B2 | 1/2014 | Akahane et al. | |
| 8,919,929 B2 | 12/2014 | Akahane et al. | |
| 10,766,257 B2 | 9/2020 | Kato | |
| 10,913,271 B2 * | 2/2021 | Kato | B41J 2/14233 |

(Continued)

FOREIGN PATENT DOCUMENTS

JP 2012-143980 A 8/2012

*Primary Examiner* — Kristal Feggins
(74) *Attorney, Agent, or Firm* — Banner & Witcoff, Ltd.

(57) ABSTRACT

There is provided a liquid discharge head including: a communication plate formed with a descender connected to a nozzle, a pressure chamber plate including a plurality of pressure chambers aligning in an array direction, a piezoelectric element, and a discharge common channel. The discharge common channel extends in the array direction, is connected to the plurality of pressure chambers, and has a first discharge portion and a second discharge portion. The discharge common channel is configured to discharge liquid toward one side in the array direction. The second discharge portion includes an expansion portion to expand beyond the first discharge portion in a width direction orthogonal to the stacking direction and to the array direction.

9 Claims, 10 Drawing Sheets

(56) References Cited

U.S. PATENT DOCUMENTS

| | | | |
|---|---|---|---|
| 2012/0182354 | A1 | 7/2012 | Akahane et al. |
| 2014/0118443 | A1 | 5/2014 | Akahane et al. |
| 2017/0120589 | A1 | 5/2017 | Miyagishi et al. |
| 2017/0151786 | A1 | 6/2017 | Tomimatsu et al. |
| 2017/0217172 | A1 | 8/2017 | Naganuma et al. |

* cited by examiner

LIQUID DISCHARGE HEAD

CROSS REFERENCE TO RELATED APPLICATION

The present application is a continuation of prior U.S. application Ser. No. 16/938,456, filed on Jul. 24, 2020, which is a continuation of prior U.S. application Ser. No. 16/225,533, filed on Dec. 19, 2018, now U.S. Pat. No. 10,766,257 B2 issued on Sep. 8, 2020, which claims priority from Japanese Patent Application No. 2018-050002 filed on Mar. 16, 2018, the disclosures of which are incorporated herein by reference in their entirety.

BACKGROUND

Field of the Invention

The present disclosure relates to a liquid discharge head such as, for example, the head of a liquid discharge apparatus.

Description of the Related Art

As an apparatus having a conventional liquid discharge head, there are known, for example, liquid discharge apparatuses. Such a publicly known liquid discharge apparatus has stacked communication plate provided with communication channels in communication with nozzles, and a channel-forming substrate provided with pressure generation chambers in communication with the communication channels. A circulation channel is provided in the communication plate and the channel-forming substrate, and the circulation channel is in communication with the pressure generation chambers and the communication channels via a circulation communication channel. Further, with the channel-forming substrate, a vibration plate is provided on the surface at the far side from the communication plate and, on the vibration plate, a pressure generating mechanism is arranged to cause a pressure change in the liquid inside the pressure generation chambers, so as to jet the liquid from the nozzles.

SUMMARY

However, because the liquid is in contact with the ambient air via the nozzles even during the time of not being jetted, there is an increase in viscosity of the liquid in the vicinity of the nozzles. In order to suppress such increase in viscosity, such liquid discharge apparatuses are known as to circulate the liquid as described above such that the liquid in the vicinity of the nozzles may not excessively reach to a high viscosity.

On this occasion, when there is a large resistance (against the liquid flow) in the circulation channel, then the liquid differs in flow speed between the downstream side and the upstream side in the circulation channel. Hence, a difference in the flow speed of the liquid also occurs between the vicinity of the nozzles on the communication channels connected at the downstream side and the vicinity of the nozzles on the communication channels connected at the downstream side, with respect to the circulation channel. As a result, there is such an unpreferable consequence that the jet feature of the liquid differs between the nozzles positioned on the downstream side and the nozzles positioned on the upstream side in the circulation channel.

The present disclosure is made to solve such problems, and an object thereof is to provide a liquid discharge head capable of facilitating improvement of the jet feature for the liquid.

According to an aspect of the present disclosure, there is provided a liquid discharge head including: a communication plate including a descender connected to a nozzle; a pressure chamber plate stacked on the communication plate, and including a plurality of pressure chambers each connected to the descender and arranged in an array direction; a piezoelectric element arranged in a position to overlap with the pressure chambers in a stacking direction of the communication plate and the pressure chamber plater; and a discharge common channel extending in the array direction, and connected to the plurality of pressure chambers. The discharge common channel includes a first discharge portion formed in the pressure chamber plate, and a second discharge portion formed in the communication plate and connected to the first discharge portion. The discharge common channel is configured to discharge liquid toward one side in the array direction. The second discharge portion includes an expansion portion to expand beyond the first discharge portion in a width direction orthogonal to the stacking direction and to the array direction.

According to the above configuration, the discharge common channel has an expansion portion wider than the first discharge portion. By virtue of this, because the discharge common channel is expanded, it is possible to lessen the resistance against the liquid flow in the discharge common channel and, furthermore, it is possible to reduce the resistance difference between the respective pressure chambers. By virtue of this, it is possible to lessen the difference in the jet speed and jet quantity of the droplets from the nozzle, arising from the resistance difference between the pressure chambers, thereby reducing the jet variation with the plurality of pressure chambers. Further, it is possible to lessen the viscosity difference of the liquid between a plurality of nozzles aligning in the flowing direction, arising from the resistance difference between the pressure chambers, thereby reducing the jet variation of the liquid.

DESCRIPTION OF THE EMBODIMENTS

First Embodiment

<Liquid Discharge Apparatus>

Figure 1:
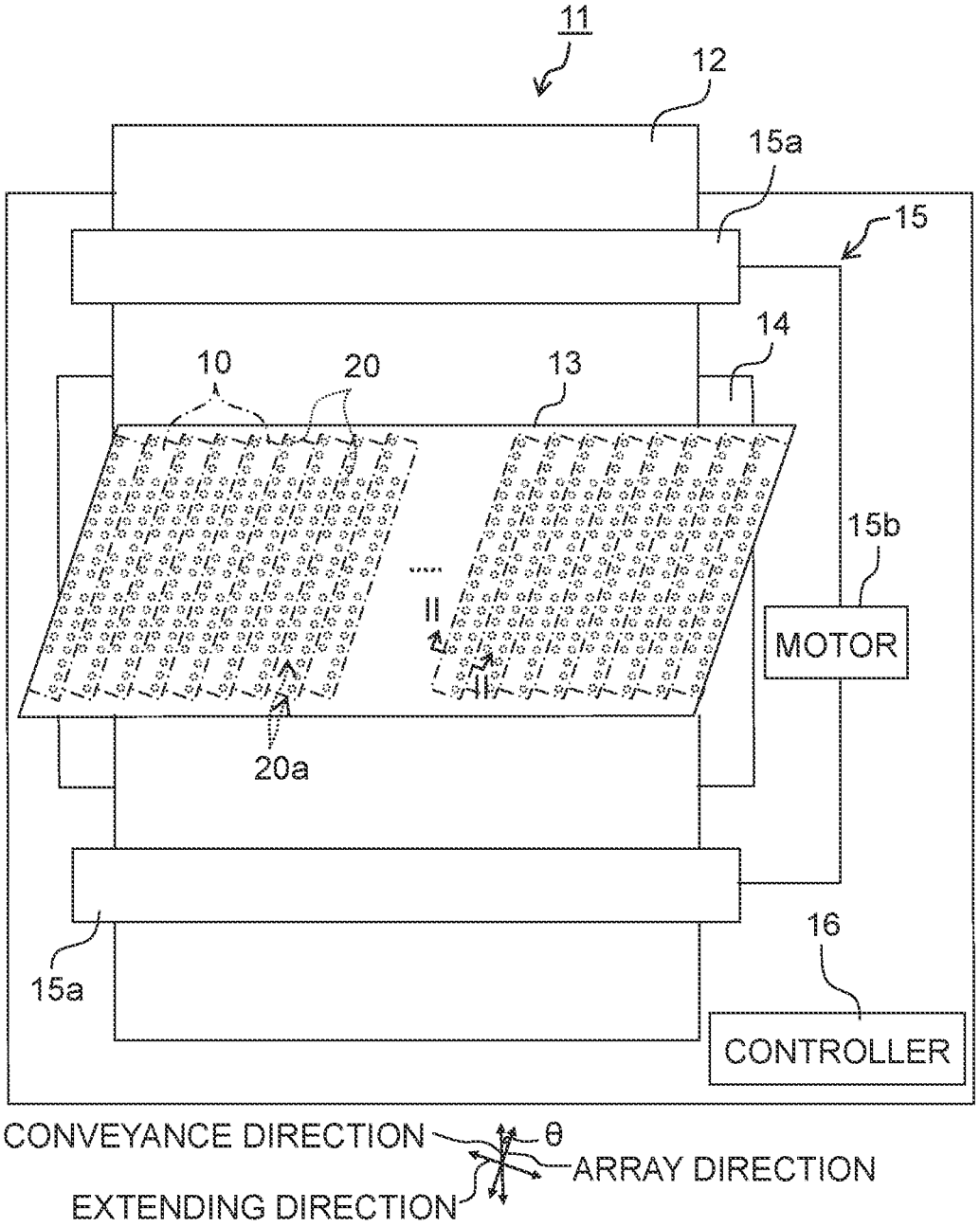
FIG. 1 is a schematic view of heads according to a first embodiment of the present disclosure.

A liquid discharge apparatus 11 using heads 10 according to a first embodiment of the present disclosure is, as depicted in FIG. 1 for example, a printer carrying out printing on recording medium 12 with the liquid by way of jetting the liquid such as ink or the like while conveying the recording medium 12 such as printing paper or the like. Note that although the liquid discharge apparatus 11 will be explained below as an apparatus using the heads 10, apparatuses using the heads 10 are not limited to the above. Further, as the liquid discharge apparatus 11, a printer will be explained below, but the liquid discharge apparatus 11 is not limited to a printer as far as it is an apparatus that discharges liquid.

The liquid discharge apparatus 11 includes a head unit 13, a platen 14, a conveyance mechanism 15, and a controller 16. The head unit 13 has the plurality of heads 10, and the plurality of heads 10 are arranged to align in a direction orthogonal to a conveyance direction. Each head 10 has a plurality of nozzles 20 jetting a liquid. The detail of the heads 10 will be explained later on.

The platen 14 is a flatbed to place the recording medium 12 and is arranged to face the nozzle surface of the heads 10 where the nozzles 20 open. The conveyance mechanism 15 is to convey the recording medium 12. The conveyance mechanism 15 has four rollers 15*a* and a conveyance motor 15*b* to drive the rollers 15*a*. The four rollers 15*a* constitute two roller pairs which are arranged to interpose the platen 14 between the two roller pairs in the conveyance direction. The two rollers 15*a* included in each roller pair are arranged to interpose the recording medium 12 therebetween, and caused to rotate reversely against each other by the conveyance motor 15*b*. By virtue of this, the recording medium 12 is conveyed along the conveyance direction. Note that such a configuration may be applied that a drive force from the conveyance motor 15*b* is transmitted to one of the two rollers 15*a* constituting each roller pair but not transmitted to the other roller 15*a*. That is, the other roller 15*a* may be a driven roller.

The controller 16 has a computation unit (not depicted) and a storage unit (not depicted). The computation unit includes a processor such as a CPU or the like while the storage unit includes a memory which can be accessed by the computation unit. The computation unit executes programs stored in the storage unit to control the head unit 13 and the conveyance mechanism 15 of the liquid discharge apparatus 11.

<Head>

As depicted in FIG. 1, in each head 10, the plurality of nozzles 20 form two nozzle arrays 20*a* aligned linearly in an array direction forming a predetermined angle θ to the conveyance direction. The two nozzle arrays 20*a* are provided to be parallel to each other at an interval along a width direction orthogonal to the array direction. Each of the two nozzle arrays 20*a* includes the same number 20 of nozzles. Further, the angle θ between the array direction and the conveyance direction is set, for example, from 30 degrees to 60 degrees.

Figure 2:
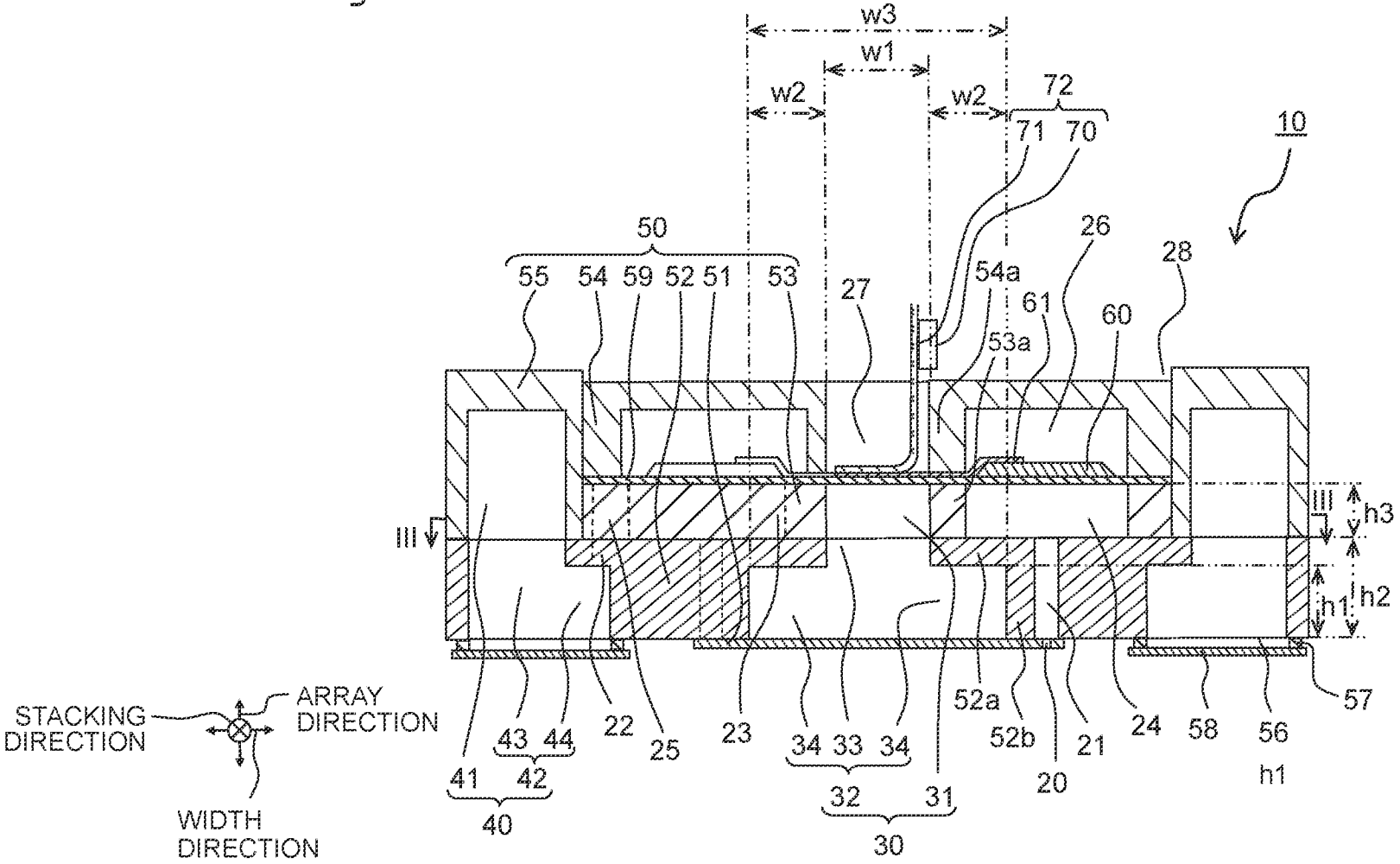
FIG. 2 is a cross-sectional view of one of the heads cut across along the line II-II of FIG. 1.
Figure 3:
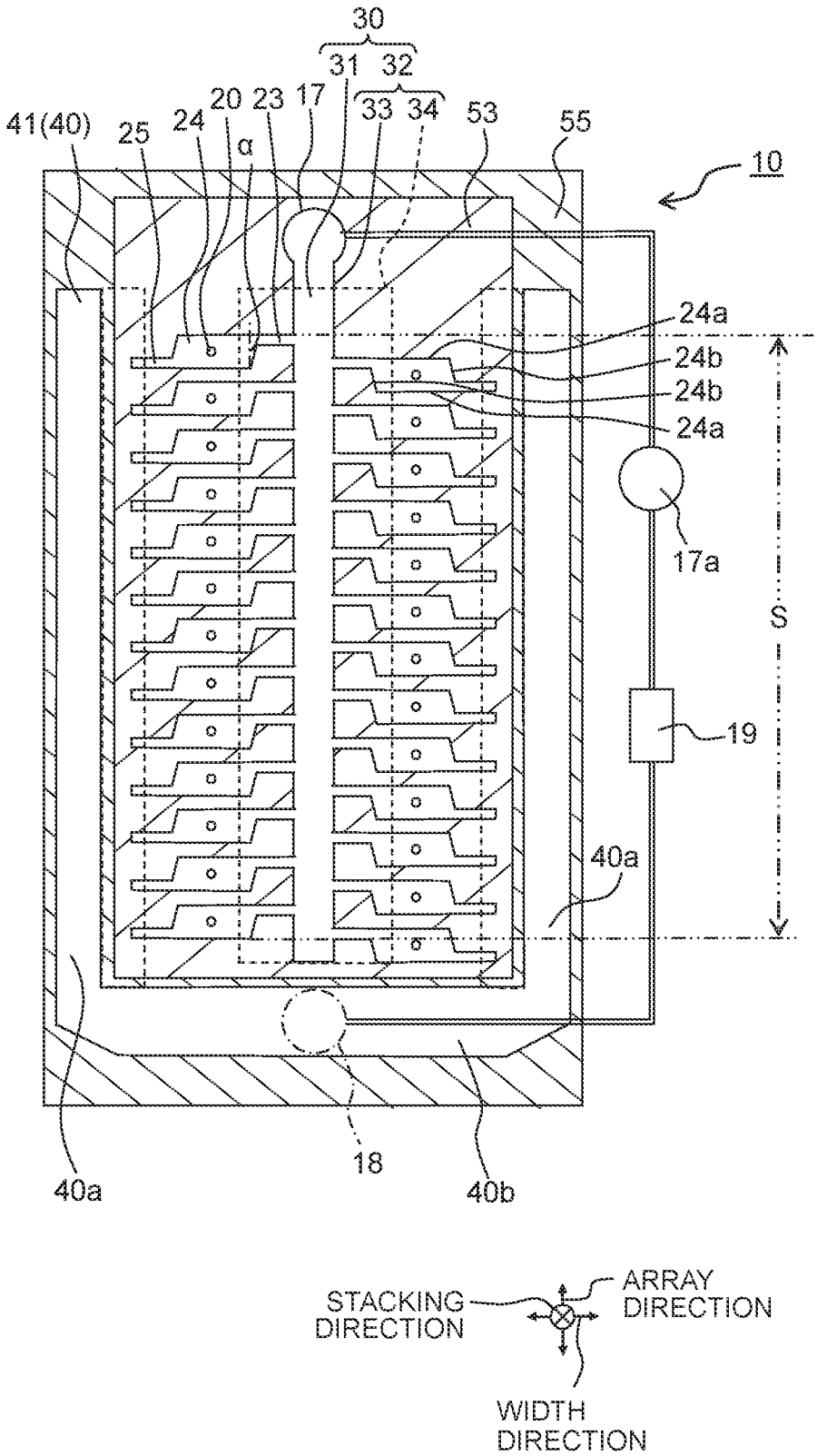
FIG. 3 is a partial cross-sectional view of the head cut across along the line of FIG. 2.

As depicted in FIGS. 2 and 3, the head 10 includes a channel forming member 50 formed with channels in communication with the nozzles 20 for the liquid to flow therethrough, piezoelectric elements 60, and a driving unit 70. Note that while the upper side refers to the side of the piezoelectric elements 60 above the side of the nozzles 20, and the lower side refers to the opposite side, the head 10 is not limited to such arrangement direction.

The channel forming member 50 has a nozzle plate 51, a communication plate 52, a pressure chamber plate 53, an accommodation plate 54, and a casing member 55. The nozzle plate 51, the communication plate 52, the pressure chamber plate 53, and the accommodation plate 54 are stacked in the numbering order and joined together with an adhesive or the like. The direction of stacking those plates (the stacking direction) is orthogonal to the array direction and the width direction. Each plate and the casing member 55 have, for example, a flat-plate shape. Each plate and the casing member 55 are formed of a metallic material such as stainless steel or the like, silicon, ceramics, or a synthetic resin material such as polyimide or the like.

The nozzle plate 51 is provided with the plurality of nozzles 20. The nozzles 20 are formed as through holes penetrating through the nozzle plate 51 in the stacking direction. The lower surface of the nozzle plate 51 forms the nozzle surface where the nozzles 20 open.

The communication plate 52 is larger than the nozzle plate 51 in length respectively along the stacking direction and the width direction. The communication plate 52 is provided with a second discharge portion 32 of a discharge common channel 30, descenders 21, communication channels 22, and second supply portions 42 of a supply common channel 40. In the width direction, two descenders 21 are provided to interpose one second discharge portion 32, and two communication channels 22 and two second supply portions 42 are provided to interpose the two descenders 21.

For example, the descenders 21 and the communication channels 22 are provided at the same number as the nozzles 20, and arrayed along the nozzle arrays 20*a* (see FIG. 1) at intervals along the array direction. On the other hand, one discharge common channel 30 and one supply common channel 40 are provided to extend parallel to each other in the array direction. The discharge common channel 30 has one end connected to a discharge tube 17, and the liquid flows in the direction from the other end to the one end of the discharge common channel 30. Therefore, the other end of the discharge common channel 30 may be referred to as on the upstream side whereas the one end as on the downstream side.

The descenders 21 are channels in communication with the nozzles 20, penetrating through the communication plate 52 to overlap with the nozzles 20 along the stacking direction.

The second discharge portion 32 has a central portion 33, and a pair of expansion portions 34 expanding from the central portion 33 along the width direction. The second discharge portion 32 penetrates through the communication plate 52 in the stacking direction, opens in the lower surface of the communication plate 52, and its opening portion is covered by the nozzle plate 51. Note that the detail of the expansion portions 34 will be described later on.

Each of the second supply portions 42 has a main portion 43, and a wide portion 44 expanding from the main portion 43 along the width direction. The wide portion 44 is provided on the lower side in the stacking direction to extend toward the descenders 21 on one side along the width direction. By virtue of this, the second supply portions 42 are formed to have an L-shaped cross section orthogonal to the array direction. The second supply portions 42 penetrate through the communication plate 52 in the stacking direction, open in the lower surface of the communication plate 52, and their opening portions are covered by a damper film 56. The opening portions of the second supply portions 42 in the lower surface of the communication plate 52 have a larger area than the opening portions in the upper surface of the communication plate 52.

The damper film 56 is a flexible film-like member, suppressing pressure variation of the liquid in the supply common channel 40 by way of deformation. The damper film 56 is covered by a damper plate 58 via a spacer 57, and protected by the damper plate 58.

The communication channels 22 are channels in communication with the second supply portions 42, extending upward from the wide portions 44 of the second supply portions 42 to penetrate through the communication plate 52 along with the wide portions 44. In the communication plate 52 above the wide portions 44, along the width direction, partitions are laid between the communication channels 22 and the main portions 43 of the second supply portions 42.

The pressure chamber plate 53 is sized as large as the communication plate 52 along the array direction, but smaller than the communication plate 52 along the width direction. The pressure chamber plate 53 is provided with first discharge portions 31 of the discharge common channel 30, discharge individual channels 23, pressure chambers 24, and supply individual channels 25. The pressure chambers 24 are individual channels for the liquid to be distributed from the supply common channel 40 and to flow into the discharge common channel 30, and are in communication with the nozzles 20. Therefore, among the individual channels between the supply common channel 40 and the discharge common channel 30, the pressure chambers 24 are channels which do not include the supply individual channels 25 connecting the supply common channel 40 and the pressure chambers 24, and the discharge individual channels 23 connecting the pressure chambers 24 and the discharge common channel 30.

One first discharge portion 31 is positioned between two discharge individual channels 23. The first discharge portion 31 and the two discharge individual channels 23 are positioned between two pressure chambers 24 along the width direction. Further, the first discharge portion 31, the two discharge individual channels 23, and the two pressure chambers 24 are positioned between two supply individual channels 25 along the width direction. For example, the discharge individual channels 23, the pressure chambers 24, and the supply individual channels 25 are provided at the same number as the nozzles 20, and arrayed along the nozzle arrays 20*a* (see FIG. 1) at intervals in the array direction.

The plurality of pressure chambers 24 are arrayed along the array direction at intervals. The pressure chambers 24 are formed as recesses in the lower surface of the pressure chamber plate 53, and such part of the pressure chamber plate 53 as above the pressure chambers 24 is used as a vibration-plate portion 59.

Note that in the above, the vibration-plate portion 59 is provided integrally with the pressure chamber plate 53 as part of the pressure chamber plate 53. However, the vibration-plate portion 59 may be provided as another member than the pressure chamber plate 53. In such cases, the pressure chambers 24 may be formed to penetrate through the pressure chamber plate 53 along the stacking direction, and a plate may be stacked on the upper surface of the pressure chamber plate 53 to form the vibration-plate portion 59.

The pressure chambers 24 open in the lower surface of the pressure chamber plate 53. The pressure chambers 24 are in communication with the descenders 21 via parts of the opening portions, and arranged to overlap with the descenders 21 along the stacking direction. The other parts of the opening portions are covered by the communication plate 52. The descenders 21 are arranged at the centers of the pressure chambers 24 along the width direction, respectively.

As depicted in FIG. 3, the pressure chambers 24 have a parallelogram shaped cross section orthogonal to the stacking direction. This parallelogram has a pair of first sides 24*a* and a pair of second sides 24*b*. The first sides 24*a* extend in the width direction while the second sides 24*b* are inclined with respect to the first discharge portion 31 extending in the array direction such that the farther downstream (to the side of the discharge tube 17), the closer to the first discharge portion 31. The inclination angle $\alpha$ between the second sides 24*b* and the first discharge portion 31 is, for example, from 25 degrees to 35 degrees. According to this, the liquid discharged to the first discharge portion 31 flows along the pair of second sides 24*b* inclined in the pressure chambers 24. Hence, it is easy to discharge bubbles contained in the liquid and it is possible to suppress jet defects of the liquid due to the bubbles.

The supply individual channels 25 are channels for branching from the one supply common channel 40 to the plurality of pressure chambers 24, in communication with the second supply portions 42 of the supply common channel 40 via the communication channels 22, as well as with the pressure chambers 24.

The supply individual channels 25 are formed to sink in from the lower surface of the pressure chamber plate 53, and open in the lower surface of the pressure chamber plate 53. The supply individual channels 25 are in communication with the communication channels 22 via parts of the opening portions, and arranged to overlap with the communication channels 22 along the stacking direction. The other parts of the opening portions are covered by the communication plate 52. The supply individual channels 25 are connected to the upstream parts of the pressure chambers 24 along the array direction.

The discharge individual channels 23 are channels for the liquid to flow from the plurality of pressure chambers 24 into the one discharge common channel 30, and extend in the width direction to render communication between the pressure chambers 24 and the first discharge portions 31 of the discharge common channel 30. The discharge individual channels 23 are formed as recesses in the lower surface of the communication plate 52. The discharge individual channels 23 open in the lower surface of the communication plate 52, and the opening portions are covered by the communication plate 52. The plurality of discharge individual channels 23 are connected to the discharge common channel 30 to be staggered in the array direction.

The discharge individual channels 23 are connected to the downstream parts of the pressure chambers 24 along the array direction, and arranged on the downstream side from the supply individual channels 25 along the array direction. By virtue of this, the liquid flows in from the supply individual channels 25 connected to the upstream parts of the pressure chambers 24 and flows out to the discharge individual channels 23 connected to the downstream parts of the pressure chambers 24. Therefore, the liquid can easily pass through the centers of the pressure chambers 24 on the cross section orthogonal to the stacking direction, such that the bubbles are more easily discharged from the pressure chambers 24, and thus it is possible to suppress jet defects for the liquid due to the bubbles.

The first discharge portions 31 are formed as recesses in the lower surface of the pressure chamber plate 53 and open in the lower surface of the pressure chamber plate 53. According to that, no other part needs to be prepared to cover the upper side of the first discharge portions 31 and, for example, it is possible to form the first discharge portions 31 easily by way of half-etching the pressure chamber plate 53.

The first discharge portions 31 are in communication with the second discharge portion 32, overlapping with the second discharge portion 32 in the stacking direction. By virtue of this, the first discharge portions 31 and the second discharge portion 32 form the discharge common channel 30 to discharge the liquid from the plurality of pressure chambers 24 via the discharge individual channels 23. Then, the first discharge portions 31 and the second discharge portion 32 extend in the array direction, being longer than a connected area S with the discharge individual channels 23 aligning in the array direction. Further, the first discharge portions 31 are sized equal to the central portion 33 of the second discharge portion 32 along the width direction. Further, the term "equal" is a concept including an allowable error such as manufacturing error or the like (for example, plus or minus 5%).

The part of the pressure chamber plate 53 left above the first discharge portions 31 is sized equal to the vibration-plate portion 59 left above the pressure chambers 24 along the stacking direction. Therefore, the first discharge portions 31 are sized equal to the pressure chambers 24 along the stacking direction. By virtue of this, for example, by eliminating the pressure chamber plate 53 from below by way of etching or the like, it is possible to form the first discharge portions 31 together with the pressure chambers 24 through the same process. Note that the term "equal" is a concept including an allowable error such as manufacturing error or the like (for example, plus or minus 5%).

The upper surfaces of the first discharge portions 31 at the far side from the second discharge portion 32 are at the same position as the upper surfaces of the pressure chambers 24 at the far side from the descenders 21, along the stacking direction. On the vibration-plate portion 59 covering the upper side of the pressure chambers 24, the piezoelectric elements 60 are arranged in positions overlapping with the pressure chambers 24 along the stacking direction, such that the first discharge portions 31 reach as high as to the surfaces of the pressure chambers 24 on the side of the piezoelectric elements 60 along the stacking direction. By virtue of this, the discharge common channel 30 is expanded.

The accommodation plate 54 is sized the same as the pressure chamber plate 53 along the array direction and the width direction. The accommodation plate 54 is provided with accommodation portions 26 and first hollow portions 27. One first hollow portion 27 is arranged between two accommodation portions 26 along the width direction.

The accommodation portions 26 are sized equal to the pressure chambers 24 along the width direction, arranged to overlap with the pressure chambers 24 along the stacking direction, and extend through a long distance along the array direction. The accommodation portions 26 are formed as recesses in the lower surface of the accommodation plate 54, and the opening portions of the recesses are covered by the vibration-plate portion 59. The piezoelectric elements 60 are arranged inside the accommodation portions 26 and the accommodation plate 54 covers the piezoelectric elements 60.

The piezoelectric elements 60 include a common electrode, piezoelectric bodies, and individual electrodes. The common electrode is provided commonly for the plurality of piezoelectric elements 60, and stacked on the vibration-plate portion 59 to cover the entire upper surface of the vibration-plate portion 59. The common electrode is connected to a common lead wire (not depicted). Note that an insulating film (not depicted) may cover the upper surface of the vibration-plate portion 59, and the common electrode may be arranged on the vibration-plate portion 59 via the insulating film. Further, the vibration-plate portion 59 may be formed integrally with the common electrode.

One piezoelectric body is provided for each pressure chamber 24, and arranged on the pressure chamber 24 via the vibration-plate portion 59 and the common electrode. The individual electrodes are arranged on the piezoelectric bodies, respectively. The individual electrodes are connected with individual lead wires 61 which are drawn out from the accommodation portions 26 to the first hollow portions 27 along the width direction.

When a voltage is applied to a certain individual electrode, then the corresponding piezoelectric body deforms such that the vibration-plate portion 59 displaces in accordance with that. With the vibration-plate portion 59 displacing toward the pressure chamber 24, the pressure chamber 24 decreases in volume. On this occasion, a pressure is applied to the liquid inside the pressure chamber 24, so as to jet the liquid from the nozzle 20 in communication with the pressure chamber 24.

The first hollow portions 27 are arranged to overlap with the first discharge portions 31 and the central portion 33 along the stacking direction to extend through a long distance along the array direction, and penetrate through the accommodation plate 54 along the stacking direction. The vibration-plate portion 59 covers the opening portions of the first hollow portions 27 in the lower surface of the accommodation plate 54. A COF 72 is arranged on the vibration-plate portion 59 inside the first hollow portions 27. Further, the upper surface of the accommodation plate 54 opens via the first hollow portions 27. Because the COF 72 is exposed through the opening portions, it is possible to connect the same with an external device such as a controller or the like.

The COF 72 (Chip On Film) has a driving unit 70 mounted on a film-like substrate 71. The driving unit 70 is, for example, a driver IC such as a semiconductor chip or the like to drive the piezoelectric elements 60. The film-like substrate 71 is, for example, a thin flexible printed circuit (FPC) formed of polyimide or the like.

One end of the film-like substrate 71 is connected electrically with the individual lead wires 61 and the common lead wire extending from the piezoelectric elements 60, and the other end of the film-like substrate 71 is connected with the controller (not depicted). By virtue of this, the driving unit 70 convers a control signal from the controller into a drive signal for the piezoelectric elements 60 to control the driving of the piezoelectric elements 60. Further, the driving unit 70 may be mounted on a rigid substrate or stacked on the vibration-plate portion 59.

The casing member 55 is sized, for example, the same as the communication plate 52 along the array direction and the width direction, and the same as or larger than the totality of the pressure chamber plate 53 and the accommodation plate 54 along the stacking direction. The casing member 55 is provided with first supply portions 41 and second hollow portions 28 of the supply common channel 40. One second hollow portion 28 is arranged between two first supply portions 41 along the width direction.

The second hollow portions 28 penetrate through the casing member 55 along the stacking direction. The second hollow portions 28 are sized the same as or larger than the pressure chamber plate 53 and the accommodation plate 54 along the width direction. With the pressure chamber plate 53 and the accommodation plate 54 being accommodated in the second hollow portions 28, the casing member 55 is stacked on the communication plate 52. Therefore, the first hollow portions 27 and the second hollow portions 28 of the accommodation plate 54 are in communication with each other and the COF 72 is arranged to be connectable with external devices via the first hollow portions 27 and the second hollow portions 28.

The second supply portions 42 are formed as recesses in the lower surface of the casing member 55 and open at the lower side. The second supply portions 42 are in communication with the first supply portions 41 via the opening portions. Along the width direction, the first supply portions 41 are sized equal to the main portions 43 of the second supply portions 42. Along the width direction, the wide portions 44 of the second supply portions 42 are sized larger than the first supply portions 41. The first supply portions 41 and the second supply portions 42 form the supply common channel 40 to supply the liquid to the plurality of pressure chambers 24 via the supply individual channels 25 in communication.

The supply common channel 40 is, as depicted in FIG. 3, formed in a U shape as viewed from above, and has a pair of first portions 40*a* extending in the array direction, and a second portion 40*b* extending in the width direction. The second portion 40*b* is connected to both ends of the pair of first portions 40*a* (the upstream ends). The second portion 40*b* is connected to one end of a supply tube 18 at the center along the width direction, and the other end of the supply tube 18 is connected to a tank 19. The tank 19 is further connected to the discharge tube 17 in which a pump 17*a* is provided.

With the pump 17*a*, the liquid flows through the discharge tube 17, and the discharge common channel 30 connected thereto and flows on into the tank 19. The liquid in the tank 19 flows through the supply tube 18 and into the second portion 40*b* of the supply common channel 40 connected thereto and, further, branches from the second portion 40*b* to flow into the pair of first portions 40*a*. Then, the liquid is distributed from the first portions 40*a* to the plurality of pressure chambers 24 via the plurality of communication channels 22 and the supply individual channels 25, flowing into the pressure chambers 24. Part of the liquid in the pressure chambers 24 flows to the nozzles 20 via the descenders 21, and the rest is discharged to the discharge common channel 30 via the discharge individual channels 23.

<Expansion Portions>

Expansion portions 34 are provided in the second discharge portion 32 in a lower part along the stacking direction, and the pair of expansion portions 34 extend respectively from the central portion 33 of the second discharge portion 32 to the two opposite sides along the width direction. Therefore, in the lower part of the second discharge portion 32, one of the pair of expansion portions 34, the central portion 33, and the other expansion portion 34 are arranged to align in the width direction.

The one expansion portion 34 and the other expansion portion 34 are arranged line-symmetrically along the width direction with respect to the central portion 33. By virtue of this, the second discharge portion 32 has such a cross section orthogonal to the array direction as formed into an inversed T shape. Formed by the second discharge portion 32, the opening portion at the lower surface of the communication plate 52 is larger in area than the opening portion at the upper surface of the communication plate 52.

Along the width direction, the area of the second discharge portion 32 formed with the expansion portions 34 is sized (between the two ends of the expansion portion 34 expanding from the central portion 33 to the two opposite sides along the width direction) larger than the first discharge portions 31 and the central portion 33 of the second discharge portion 32. For example, the width w1 of the central portion 33 is from 400 μm to 500 μm, while the width w2 of each expansion portion 34 is 100 μm and the maximum width w3 from one to the other of the expansion portions 34 is from 600 μm to 700 μm.

The pressure chambers 24 are sized 500 μm along the width direction. When the half size of the descenders 21 and the minimum size of wall portions 52*b* between the descenders 21 and the expansion portions 34 are subtracted from the half size of the pressure chambers 24 (250 μm), then the result of, that is 100 μm. This 100 μm or so is assigned to the expansion portions 34. That is, due to the expansion portions 34, the maximum width of the second discharge portion 32 is wider than the maximum width of the first discharge portions 31. By virtue of this, the second discharge portion 32 spreads to overlap with not only the first discharge portions 31 but also the pressure chambers 24 and discharge individual channels 23 along the stacking direction.

Hence, the cross section of the discharge common channel 30 orthogonal to the array direction is expanded. Therefore, there is a lessened resistance against the liquid flowing through the discharge common channel 30 so as to reduce the difference in flow speed between the plurality of pressure chambers 24 aligning in that flowing direction and in communication with the discharge common channel 30. By virtue of this, between the plurality of nozzles 20 in respective communication with the plurality of pressure chambers 24, there are lessened variations respectively in the liquid viscosity inside the nozzles 20 and in the speed and the quantity of the droplets jetted from the nozzles 20 over the time, such that it is possible to facilitate improvement of the jet feature for the liquid.

Further, the expansion portions 34 are arranged between the descenders 21 and the first discharge portions 31 along the width direction. By virtue of this, it is possible to provide the expansion portions 34 without the head 10 growing in size by effectively using such parts as the expansion portions 34 between the descenders 21 and the first discharge portions 31 in the communication plate 52.

Further, the expansion portions 34 are formed in the communication plate 52 to overlap with the pressure chambers 24 along the stacking direction. By virtue of this, it is possible to provide the expansion portions 34 without the head 10 growing in size by effectively using such parts in the communication plate 52 overlapping with the pressure chambers 24 as the expansion portions 34.

Further, the expansion portions 34 are formed in the communication plate 52 as recesses in the surface at the far side from the pressure chamber plate 53. For example, it is possible to form the expansion portions 34 easily by way of half-etching, without needing to otherwise use the parts for partitioning the pressure chambers 24, and the discharge individual channels 23 and expansion portions 34.

The expansion portion 34 is sized equal to the wide portion 44 along the stacking direction, and from the lower surface of the communication plate 52, the part to the upper surface of the expansion portion 34 is sized equal to the part to the upper surface of the wide portion 44. For example, when the expansion portion 34 and the wide portion 44 are formed as recesses in the lower surface of the communication plate 52 by way of half etching, then because the processing time is equal to each other, it is possible to easily form the expansion portion 34 and the wide portion 44 through an identical process. Note that the term "equal" is a concept including an allowable error such as manufacturing error or the like (for example, plus or minus 5%).

The descenders 21 are arranged in the centers of the pressure chambers 24 along the width direction. By virtue of this, it is possible to enlarge the size of the expansion portions 34 arranged between the descenders 21 and the first discharge portions 31 along the width direction. Further, in the centers of the pressure chambers 24, the vibration plate is subject to a large displacement due to the piezoelectric elements 60 and, because the liquid is under a large pressure, it is possible to jet the liquid effectively. Note that the term "center" is a concept including an allowable error such as manufacturing error or the like (for example, an error within plus or minus 5% along the width direction with respect to the center).

For example, in the discharge common channel 30, along the stacking direction, the size h3 of the first discharge portions 31 is 70 μm, the size h2 of the second discharge portion 32 is 400 μm, and the size h1 of the expansion portion 34 is from 150 μm or to 150 μm. In this manner, the size h1 is about half of the size h2 (400 μm) of the communication plate 52. When the size h1 is too large, then the communication plate 52 will be too weak in strength. On the other hand, when the size h1 is too small, then it will be difficult to sufficiently lessen the resistance against the liquid flow in the discharge common channel 30.

Further, in the communication plate 52, the wall portions 52*a* are sized 30 μm or more between the pressure chambers 24 and discharge individual channels 23, and the expansion portion 34 along the stacking direction. It is possible to size the wall portions 52*a* from 150 μm to 250 μm. By virtue of this, it is possible to sufficiently lessen the resistance against the liquid flow in the discharge common channel 30, while it is possible to still maintain the durability of the communication plate 52 even though the expansion portion 34 is provided.

Along the stacking direction, the wall portions 54*a* of the accommodation plate 54 between the first hollow portions 27 and the accommodation portions 26 are arranged not to overlap with the first discharge portions 31 and the central portion 33, but to overlap with the wall portions 53*a* of the pressure chamber plate 53 between the pressure chambers 24 and the first discharge portions 31, and with the wall portions 52*a*. Therefore, when stacking the accommodation plate 54 onto the vibration-plate portion 59 and joining the lower ends of the wall portions 54*a* to the vibration-plate portion 59 with an adhesive or the like, the wall portions 54*a* are supported by the wall portions 52*a* via the wall portions 53*a*. Hence, it is possible to lessen damage to the vibration-plate portion 59.

First Modified Embodiment

Figure 4A:
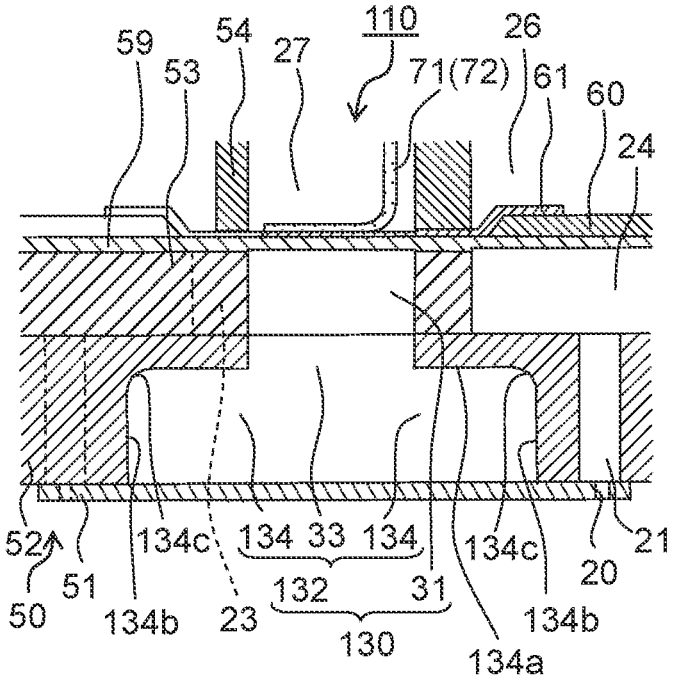
FIG. 4A is a schematic view of part of a head according to a first modified embodiment of the present disclosure.

In a head 110 according to a first modified embodiment based on the first embodiment, as depicted in FIG. 4A, an expansion portion 134 of a second discharge portion 132 of a discharge common channel 130 has an angular portion 134*c* whose cross-sectional shape orthogonal to the array direction is curved. For example, the expansion portion 134 may have the angular portion 134*c* curved between a surface 134*a* intersecting the width direction and surfaces 134*b* intersecting the stacking direction.

For example, the expansion portion 134 is enclosed circumferentially in the communication plate 52 by a surface (the upper surface 134*a*) intersecting the stacking direction (being orthogonal thereto for example), a pair of surfaces (the lateral surfaces 134*b*) intersecting the width direction (being orthogonal thereto for example), and a pair of surfaces (the end surfaces) intersecting the array direction (being orthogonal thereto for example). The angular portion 134*c* between the upper surface 134*a* and the lateral surfaces 134*b* is formed by a curved surface chamfered into an arc-like shape curved at a cross section along the array direction. Because the liquid smoothly flows along the angular portion 134*c* in such a curved shape, it is possible to prevent bubbles contained in the liquid from being detained in the expansion portion 134, so as to suppress the liquid jet defects due to the bubbles.

Second Modified Embodiment

Figure 4B:
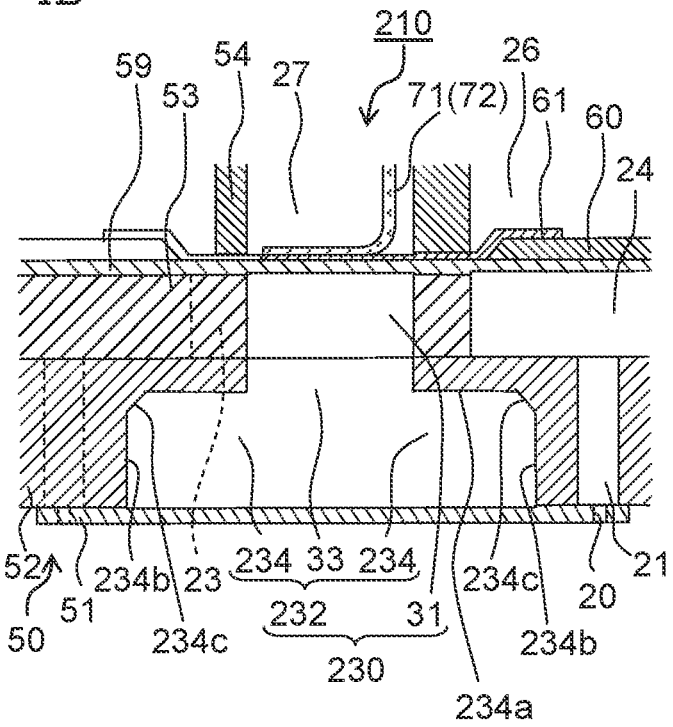
FIG. 4B is a schematic view of part of a head according to a second modified embodiment of the present disclosure.

In a head 210 according to a second modified embodiment based on the first embodiment, as depicted in FIG. 4B, an expansion portion 234 of a second discharge portion 232 of a discharge common channel 230 has an angular portion 234*c* whose cross-sectional shape orthogonal to the array direction is inclined. For example, the expansion portion 234 may have the angular portion 234*c* inclined between a surface 234*a* intersecting the width direction and surfaces 234*b* intersecting the stacking direction.

For example, the expansion portion 234 is enclosed circumferentially in the communication plate 52 by an upper surface 234*a*, a pair of lateral surfaces 234*b*, and a pair of end surfaces. The angular portion 234*c* between the upper surface 234*a* and the lateral surfaces 234*b* is formed by an inclined surface chamfered into an oblique line inclined with respect to the upper surface 234*a* and the lateral surfaces 234*b* at a cross section along the array direction. Because the liquid smoothly flows along the angular portion 234*c* in such an inclined shape, it is possible to prevent bubbles contained in the liquid from being detained in the expansion portion 234, so as to suppress the liquid jet defects due to the bubbles.

Third Modified Embodiment

Figure 5:
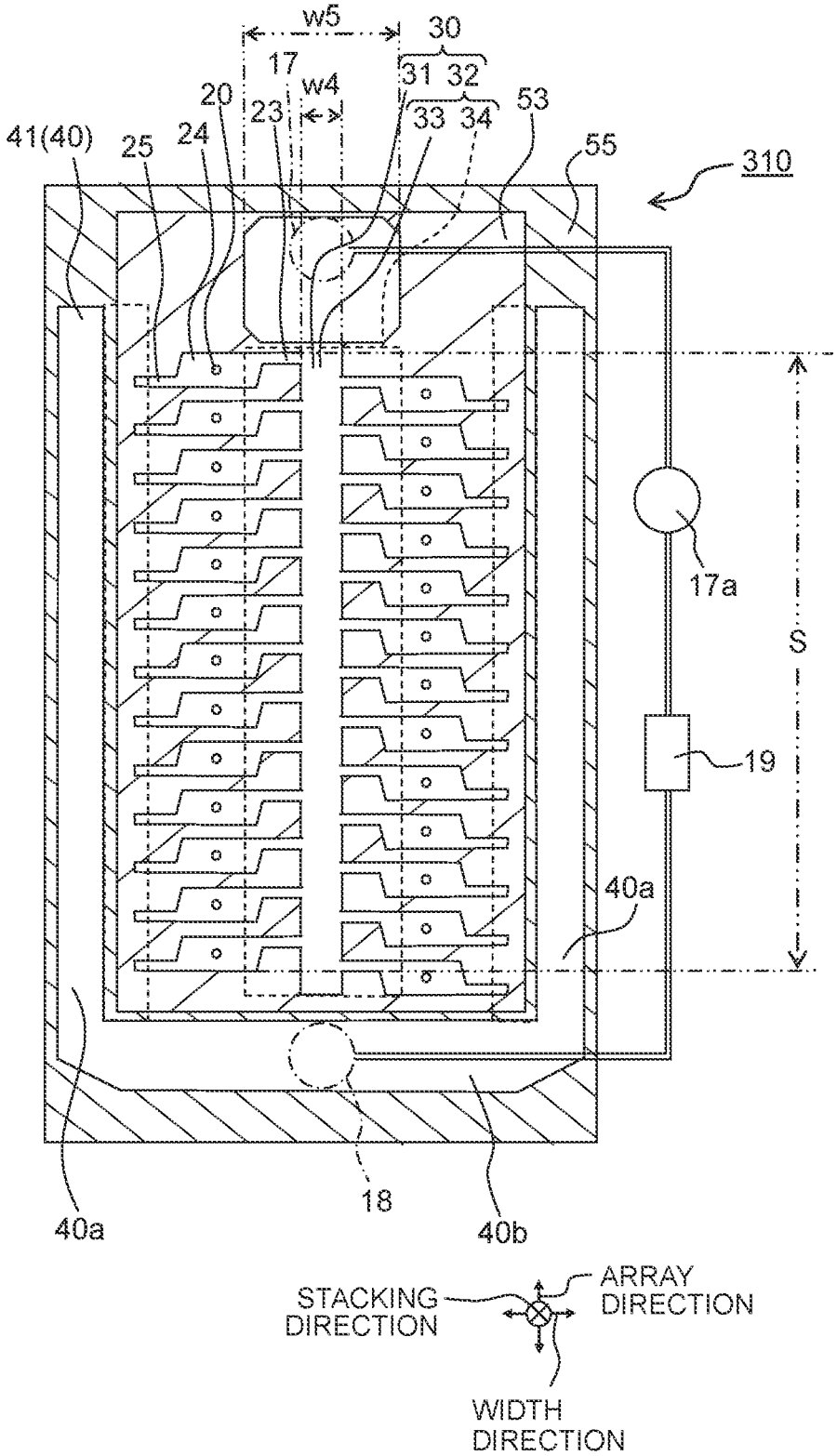
FIG. 5 is a schematic view of part of a head according to a third modified embodiment of the present disclosure.

In a head 310 according to a third modified embodiment based on the first embodiment, as depicted in FIG. 5, a discharge common channel 330 is sized larger along the width direction on the downstream side from the connected area S with the plurality of discharge individual channels 23 along the array direction, than along the width direction in the connected area S.

In particular, the plurality of discharge individual channels 23 are connected to the discharge common channel 330 from the two opposite sides along the width direction to be staggered in the array direction. The connected area S is provided between the discharge individual channels 23 connected at the farthest downstream point and the discharge individual channels 23 connected at the farthest upstream point, along the array direction. The connected area S is arranged in the discharge common channel 330 near the upstream end side at the far side from the downstream end side connected with the discharge tube 17. The discharge common channel 330 on the downstream side from the connected area S is sized larger along the width direction than the discharge common channel 330 in the connected area S along the width direction. Here, the discharge common channel 330 has a pair of lateral surfaces facing each other along the width direction in a parallel fashion.

For example, along the width direction, the discharge common channel 330 has a size w4 from 400 μm to 500 μm in the connected area S, whereas the discharge common channel 330 has a size w5 from 800 μm to 900 μm on the downstream side from the connected area S. By virtue of this, it is possible to sufficiently lessen the resistance against the liquid flow in the discharge common channel 330, while restraining the head 310 from upsizing.

By virtue of that, with the discharge common channel 330 being broadened in width, the resistance is further lessened against the liquid flow in the discharge common channel 330. Hence, between the upstream side and the downstream side in the discharge common channel 330, there is a lessened difference in the flow speed of the liquid flowing through the pressure chambers 24 in communication with the discharge common channel 330, such that it is possible to further facilitate improvement of the liquid jet features.

Note that by upsizing both the first discharge portions 31 and the second discharge portion 32 along the width direction, the discharge common channel 330 may be upsized along the width direction on the downstream side from the connected area S. Alternatively, by letting the first discharge portions 31 have a constant size along the width direction, and upsizing the second discharge portion 32 along the width direction, the discharge common channel 330 may be upsized along the width direction on the downstream side from the connected area S. Still alternatively, by letting the second discharge portion 32 have a constant size along the width direction, and upsizing the first discharge portions 31 along the width direction, the discharge common channel 330 may be upsized along the width direction on the downstream side from the connected area S.

Further, in the third modified embodiment, in the same manner as the first modified embodiment, the angular portion of the second discharge portion 32 may be curved. Further, in the third modified embodiment, in the same manner as the second modified embodiment, the angular portion of the second discharge portion 32 may be inclined.

Second Embodiment

Figure 6:
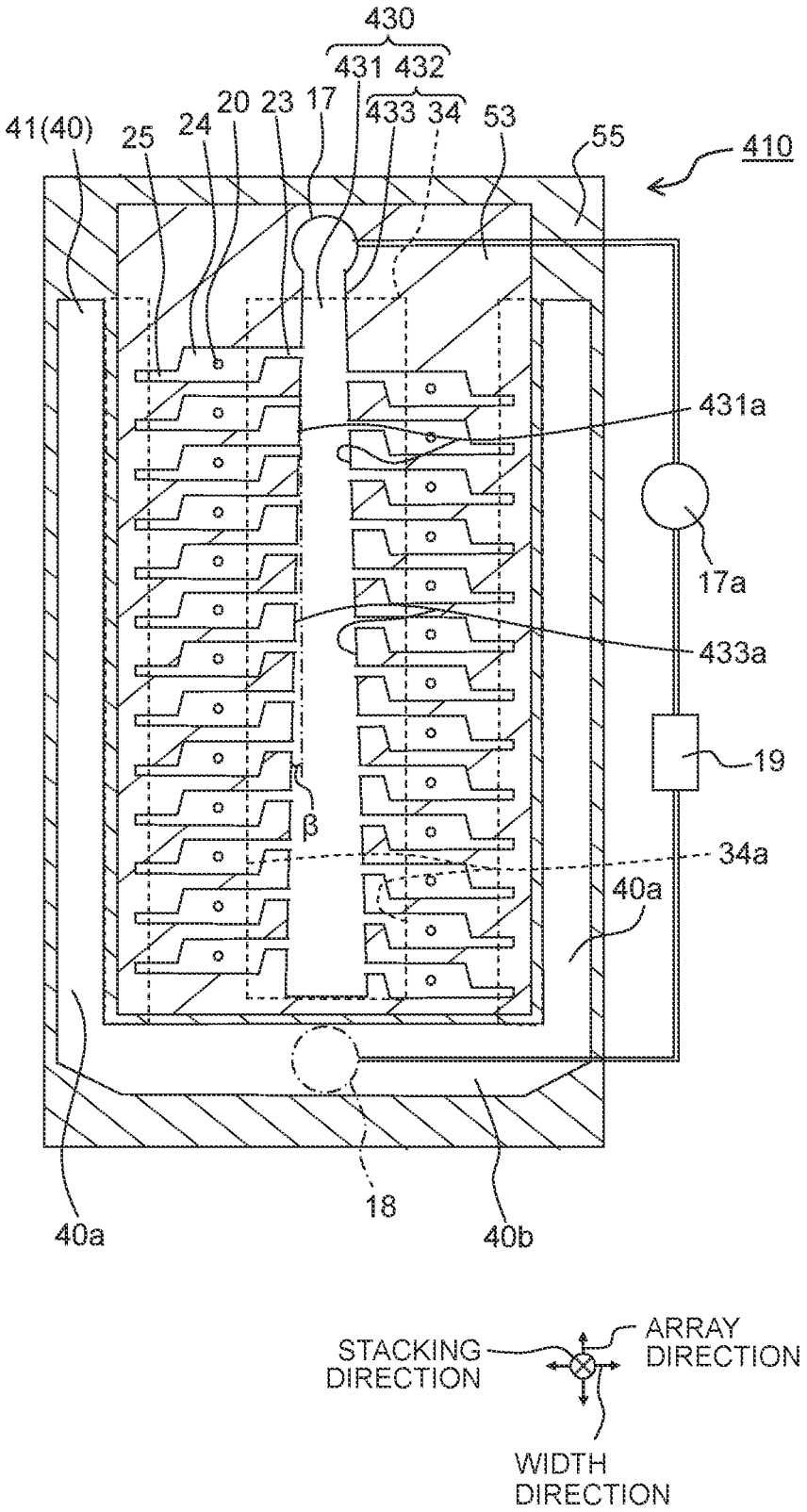
FIG. 6 is a cross-sectional view of a head according to a second embodiment of the present disclosure.

In a head 410 according to a second embodiment of the present disclosure, as depicted in FIG. 6, the farther downstream, the smaller a discharge common channel 430 is sized along the width direction. The other aspects are all the same as the head 10 according to the first embodiment, and hence explanations for the configuration, functions and effects are omitted.

That is, in the discharge common channel 430, a first discharge portion 431 has a pair of surfaces (first opposite surfaces 431*a*) facing each other along the width direction, and a central portion 433 of a second discharge portion 432 has a pair of surfaces (second opposite surfaces 433*a*) facing each other along the width direction. Each of the pair of first opposite surfaces 431*a* and each of the pair of second opposite surfaces 433*a* are inclined with respect to the symmetrical line in the width direction such that the farther downstream to the discharge tube 17, the smaller the interval along the width direction. The first opposite surfaces 431*a* and the second opposite surfaces 433*a* are gradually inclined at a certain angle β to extend linearly in the array direction. For example, because it is possible to upsize the discharge common channel 430 by the length of the discharge individual channels 23 along the width direction, in the discharge common channel 430 sized 30 mm along the array direction, the angle β of the first opposite surfaces 431*a* and the second opposite surfaces 433*a* is 89 degrees or less.

By virtue of this, the farther downstream, the smaller the area of the cross section orthogonal to the array direction in the discharge common channel 430; therefore, the farther downstream, the larger the resistance against the liquid flow in the discharge common channel 430. Hence, between upstream and downstream in the discharge common channel 430, it is possible to lessen the difference in the flow speed of the liquid flowing through the discharge individual channels 23 connected to the discharge common channel 430, thereby facilitating improvement of the liquid jet features.

Further, as the farther downstream along the array direction, the smaller the first discharge portion 431 is sized along the width direction, in the plurality of discharge individual channels 23 aligning in the array direction, the farther downstream, the smaller the discharge individual channels 23 are sized along the width direction. By virtue of this, the farther downstream, the larger the resistance against the liquid flowing from the pressure chambers 24 to the discharge common channel 430 through the discharge individual channels 23. Hence, it is possible to lessen the difference in the resistance against the liquid flowing through the pressure chambers 24 aligning in the array direction, thereby reducing the variation in the liquid jets.

Here, in the discharge common channel 430, an expansion portion 234 of the second discharge portion 432 is sized constant along the width direction without changing along the array direction. By virtue of this, the expansion portion 234 has such a pair of surfaces (the third opposite surfaces 34*a*) facing each other along the width direction as to extend parallel to each other.

Fourth Modified Embodiment

Figure 7:
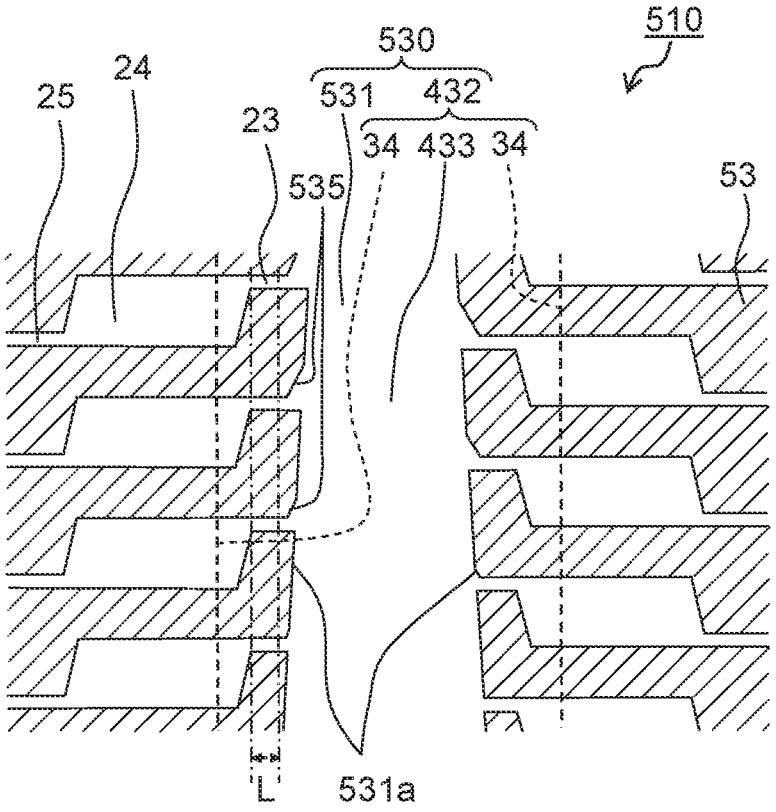
FIG. 7 is a schematic cross-sectional view of a head according to a fourth modified embodiment of the present disclosure.

In a head 510 according to a fourth modified embodiment based on the second embodiment, as depicted in FIG. 7, notches 535 are provided in a connected part with the discharge individual channels 23 in a first discharge portion 531 of a discharge common channel 530. The notches 535 are formed to sink in toward the discharge individual channels 23 from first opposite surfaces 531*a* of the first discharge portion 531 such that the discharge individual channels 23 may spread in the array direction toward the first discharge portion 531.

The farther downstream along the array direction, the larger the interval between the pressure chambers 24 and the first discharge portion 531 connected by the discharge individual channels 23. Therefore, because the farther downstream, the larger the notches 535 are sized along the width direction, in the plurality of discharge individual channels 23 aligning in the array direction, the size L along the width direction is equal to each other. By virtue of this, there is a unified resistance against the liquid flowing through the plurality of discharge individual channels 23 aligning in the array direction.

Fifth Modified Embodiment

Figure 8:
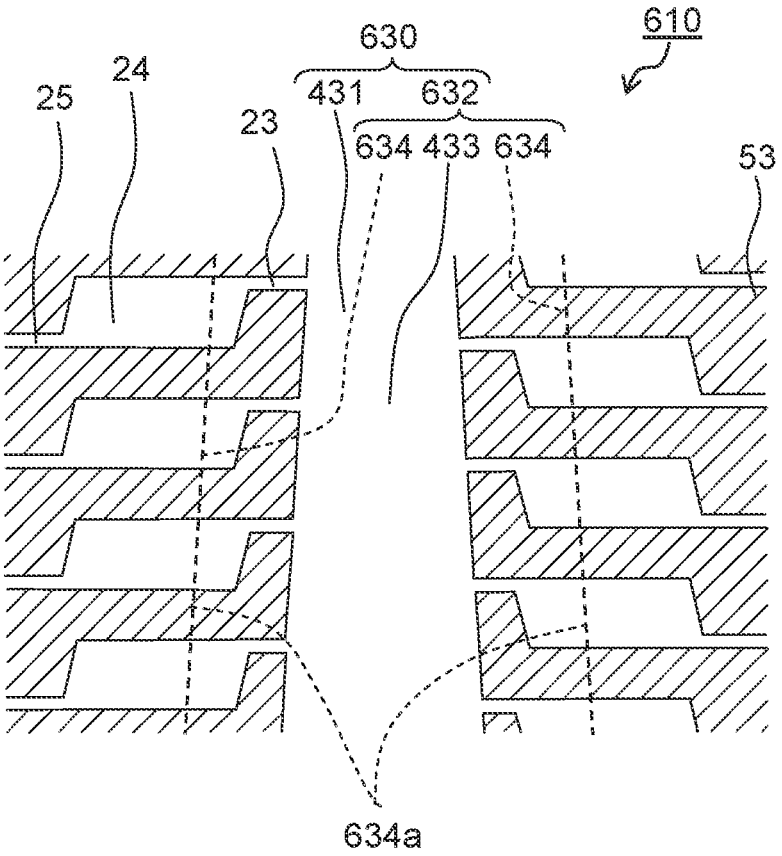
FIG. 8 is a schematic cross-sectional view of part of a head according to a fifth modified embodiment of the present disclosure.

In a head 610 according to a fifth modified embodiment based on the second embodiment, as depicted in FIG. 8, in a discharge common channel 630, the farther downstream, the smaller an expansion portion 634 is sized along the width direction. Also, in the discharge common channel 630, the farther downstream, the smaller the first discharge portion 431 and the central portion 433 of a second discharge portion 632 are sized along the width direction.

A pair of third opposite surfaces 634*a* of the expansion portion 634 are inclined with respect to the symmetrical line in the array direction such that the farther downstream, the smaller the interval along the width direction. Therefore, the third opposite surfaces 634*a* are gradually inclined at a certain angle to extend linearly in the array direction. By virtue of this, due to the expansion portion 634, in addition to the first discharge portion 431 and the central portion 433 of the second discharge portion 632, the area of the cross section orthogonal to the array direction in the discharge common channel 630 is even smaller on the farther downstream side; therefore, it is possible to further facilitate improvement of the liquid jet features.

Sixth Modified Embodiment

Figure 9:
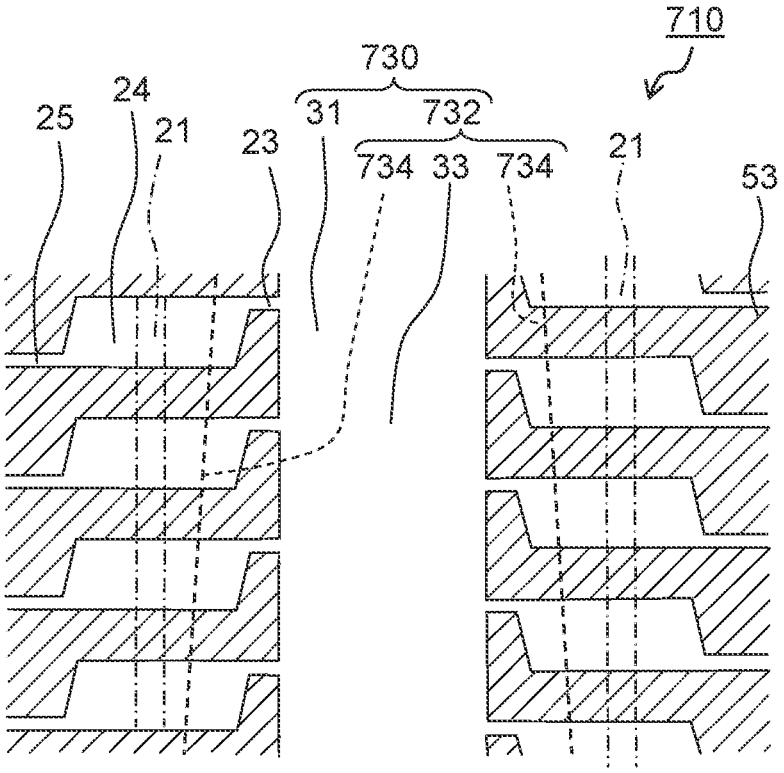
FIG. 9 is a schematic cross-sectional view of part of a head according to a sixth modified embodiment of the present disclosure.

In a head 710 according to a sixth modified embodiment based on the second embodiment, as depicted in FIG. 9, in a discharge common channel 730, the first discharge portions 31 and the central portion 33 of a second discharge portion 732 are sized constant along the width direction without changing along the array direction and, in the same manner as the expansion portion 634 of FIG. 8, the farther downstream, the smaller an expansion portion 734 is sized along the width direction. By virtue of this, due to the expansion portion 734, the area of the cross section orthogonal to the array direction in the discharge common channel 730 is smaller on the farther downstream side; therefore, it is possible to facilitate improvement of the liquid jet features.

Further, when there is a wider interval between the adjacent descenders 21 than that between the adjacent pressure chambers 24 along the width direction, then it is possible to easily adjust the size of any expansion portion 734 between the adjacent descenders 21.

Seventh Modified Embodiment

Figure 10:
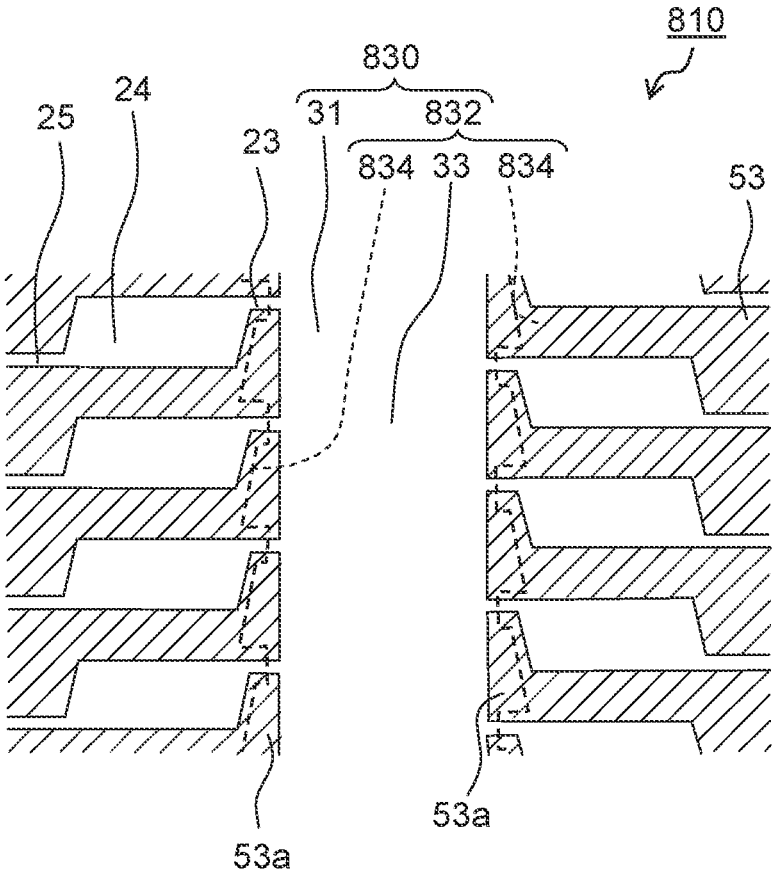
FIG. 10 is a schematic cross-sectional view of part of a head according to a seventh modified embodiment of the present disclosure.

In a head 810 according to a seventh modified embodiment based on the second embodiment, as depicted in FIG. 10, an expansion portion 834 of a second discharge portion 832 in a discharge common channel 830 is formed in the communication plate 52 to overlap along the stacking direction with the wall portions 53*a* between the pressure chambers 24 and the first discharge portions 31 in the pressure chamber plate 53.

In particular, the plurality of discharge individual channels 23 are arrayed at intervals along the array direction. Therefore, the expansion portion 834 has areas overlapping with the discharge individual channels 23 and areas overlapping with the intervals between the discharge individual channels 23. In the expansion portion 834, the areas overlapping with the discharge individual channels 23 are sized smaller along the width direction than the areas overlapping with the intervals between the discharge individual channels 23, being 150 μm or less for example. By virtue of this, along the width direction, when the discharge individual channels 23 are sized 200 μm along the width direction, then because it is possible to secure 50 μm or more of the areas not overlapping with the expansion portion 834 among the discharge individual channels 23, it is possible to lessen rigidity decrease in the head 810.

Further, in the areas overlapping with the intervals between the discharge individual channels 23, the expansion portion 834 is provided at the side of the discharge common channel 830 distanced from the pressure chambers 24 along the width direction, so as not to overlap with the pressure chambers 24 along the stacking direction. Along the width direction, the expansion portion 834 is sized smaller than the maximum span between two pressure chambers 24 aligning in the width direction. Hence, the expansion portion 834 has little area overlapping with the discharge individual channels 23 and the pressure chambers 24, and overlaps with the wall portion of the pressure chamber plate 53. Therefore, it is possible to lessen the rigidity decrease in the head 810 because of the expansion portion 834.

Here, the first discharge portions 31 and the central portion 33 of the second discharge portion 832 are sized constant along the width direction without changing along the array direction. However, it is allowable that the farther downstream, the smaller they are sized.

Note that in the heads 410, 510, 610, 710, and 810 according to the second embodiment and the modified embodiments based thereon, the angular portions of the second discharge portions 432, 632, 732, and 832 may be curved as in the first modified embodiment, or inclined as in the second modified embodiment. Further, in the heads 410, 510, 610, 710, and 810 according to the second embodiment and the four modified embodiment based thereon, as in the third modified embodiment, the discharge common channels 430, 530, 630, 730, and 830 may be sized larger along the width direction on the downstream side from the connected area S.

Further, in the heads 610 and 810 according to the fifth and seventh modified embodiments, the notches 535 may be provided in the discharge common channels 630 and 830 as in the fourth modified embodiment.

Note that in all the above embodiments, as far as not excluding the corresponding part from each other, every member may be combined with every other member. Further, the above explanation should be paraphrased as exemplifications and the present disclosure is provided for the purpose to inform those skilled in the art of the best mode for carrying out the invention. It is possible to practically change and modify the details of the structure and/or function of the present disclosure without departing from the true scope and spirit of the present disclosure.

The head of the present disclosure is usable as a liquid discharge head capable of facilitating improvement in liquid jet features.

What is claimed is:

1. A liquid discharge head comprising:

a communication plate including a descender connected to a nozzle;

a pressure chamber plate stacked on the communication plate, and including a plurality of pressure chambers each connected to the descender and arranged in an array direction;

a piezoelectric element arranged in a position to overlap with the pressure chambers in a stacking direction of the communication plate and the pressure chamber plate;

a first common channel which extends in the array direction; and a second common channel which extends in the array direction, wherein the first common channel is formed in the communication plate, and wherein the second common channel includes:

a first portion formed in the pressure chamber plate; and a second portion formed in the communication plate and connected to the first portion.

2. The liquid discharge head according to claim 1, wherein in the pressure chamber plate, the first portion extends up to a same height as the pressure chambers in the stacking direction.

3. The liquid discharge head according to claim 1, wherein the second portion includes an expansion portion to expand beyond the first portion in a width direction orthogonal to the stacking direction and to the array direction.

4. The liquid discharge head according to claim 1, further comprising a casing member stacked on the communication plate, wherein the first common channel includes a third portion formed in the casing member, and a fourth portion formed in the communication plate and connected to the third portion.

5. The liquid discharge head according to claim 4, wherein the fourth portion is wider than the third portion in a width direction orthogonal to the stacking direction.

6. The liquid discharge head according to claim 5, wherein the fourth portion includes:

a first narrow portion; and a first wide portion connected to the first narrow portion and being wider than the first narrow portion in the width direction, wherein the second portion includes:

a second narrow portion; and a second wide portion connected to the second narrow portion and being wider than the second narrow portion in the width direction, wherein a height, in the stacking direction, of the fourth portion at a boundary between the first narrow portion and the first wide portion is same as a height, in the stacking direction, of the second portion at a boundary between the second narrow portion and the second wide portion.

7. The liquid discharge head according to claim 1, wherein a width of the second common channel in a width direction orthogonal to the stacking direction becomes smaller toward a downstream of the second common channel.

8. The liquid discharge head according to claim 1, wherein the plurality of pressure chambers are arranged in two rows, and wherein the second common channel is located between the two rows of the pressure chambers in a width direction orthogonal to the stacking direction and to the array direction.

9. The liquid discharge head according to claim 8, wherein one of the two rows of the pressure chambers is located between the first common channel and the second common channel in the width direction.

* * * * *